US009540819B1

(12) United States Patent
Boyd

(10) Patent No.: US 9,540,819 B1
(45) Date of Patent: Jan. 10, 2017

(54) ADJUSTABLE COPING CAP

(71) Applicant: Jimmy Boyd, Corsicana, TX (US)

(72) Inventor: Jimmy Boyd, Corsicana, TX (US)

( * ) Notice: Subject to any disclaimer, the term of this patent is extended or adjusted under 35 U.S.C. 154(b) by 0 days.

(21) Appl. No.: 14/982,107

(22) Filed: Dec. 29, 2015

(51) Int. Cl.
*E04D 3/40* (2006.01)
*E04F 19/02* (2006.01)

(52) U.S. Cl.
CPC ..... *E04D 3/405* (2013.01); *E04F 19/02* (2013.01)

(58) Field of Classification Search
CPC ..... E04D 3/405; E04F 19/02
See application file for complete search history.

(56) References Cited

U.S. PATENT DOCUMENTS 1,497,936 A * 6/1924 Oliver ..... E04C 5/18 52/647
2,281,092 A 4/1942 Andrews
4,083,158 A * 4/1978 Wolma ..... E04D 3/405 52/300
4,843,783 A * 7/1989 Taravella ..... E04F 19/02 52/212
4,964,248 A * 10/1990 Braine ..... E04D 3/405 52/300
5,239,791 A * 8/1993 Mills, Jr. ..... E04D 3/405 52/300
5,772,185 A 6/1998 Pulsipher
D471,284 S 3/2003 Heath
6,786,018 B2 9/2004 Webb
2004/0074175 A1* 4/2004 Tierney ..... E04F 13/0864 52/255
2005/0252112 A1* 11/2005 Yoshida ..... E04F 19/02 52/202
2014/0118196 A1* 5/2014 Koskiniemi ..... H01Q 1/42 343/702

FOREIGN PATENT DOCUMENTS

CA 2023344 A1 7/1991
DE 1659337 B1 * 8/1971 ..... E04D 3/405
FR 2345898 A1 * 10/1977 ..... A01B 63/245

* cited by examiner

*Primary Examiner* — Jeanette E Chapman
(74) *Attorney, Agent, or Firm* — Kyle A. Fletcher, Esq.

(57) ABSTRACT

The adjustable coping cap is a prefabricated coping cap that it adjustable to the width of a wall. Specifically, the width of the adjustable coping cap is readily adjustable for use from a minimum wall width to a maximum minimum wall width that is up to three inches wider than the minimum wall width. The adjustable coping cap comprises a first wing, a second wing, and an adjustable plate.

12 Claims, 3 Drawing Sheets

ADJUSTABLE COPING CAP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of vertical structures with upper protective plates overlapping the edge, more specifically, a coping cap that is adjustable to the thickness of a wall.

Within the construction industry, the fit of coping caps must be measured and then prepared at a metal shop or on-site by a metal worker to fit the coping cap to the structure. Each coping cap must then be identified and matched to the specific portion of the structure for which it is intended. This procedure is an expensive and time consuming process which is prone to mistakes.

SUMMARY OF INVENTION

This disclosure addresses the above shortcomings with coping caps.

The adjustable coping cap is a prefabricated coping cap that it adjustable to the width of a wall. Specifically, the width of the adjustable coping cap is readily adjustable for use from a minimum wall width to a maximum minimum wall width that is up to three inches wider than the minimum wall width.

These together with additional objects, features and advantages of the adjustable coping cap will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable coping cap in detail, it is to be understood that the adjustable coping cap is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable coping cap.

It is therefore important that the claims be regarded as including such equivalent construction insofar as they do not depart from the spirit and scope of the adjustable coping cap. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
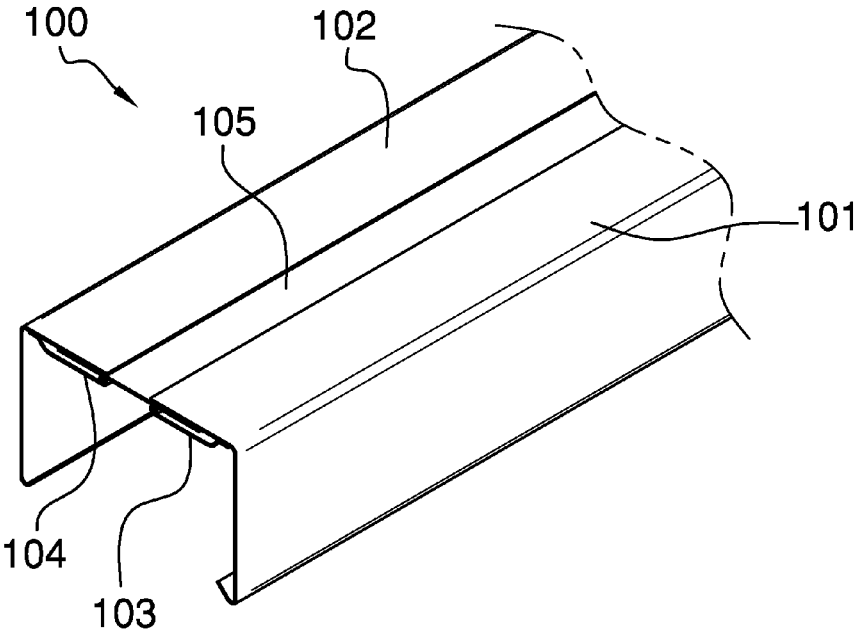
FIG. 1 is a perspective view of an embodiment of the disclosure.
Figure 2:
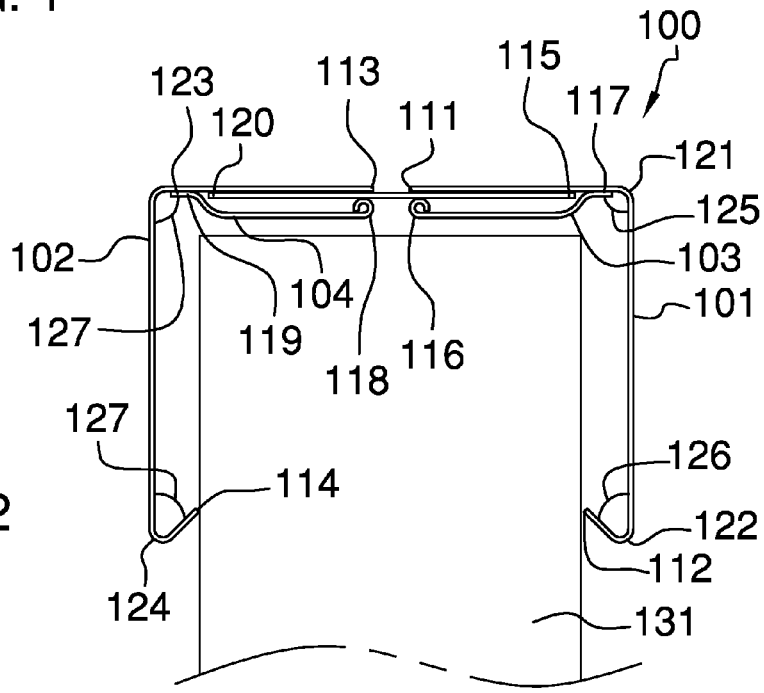
FIG. 2 is a front view of an embodiment of the disclosure.
Figure 3:
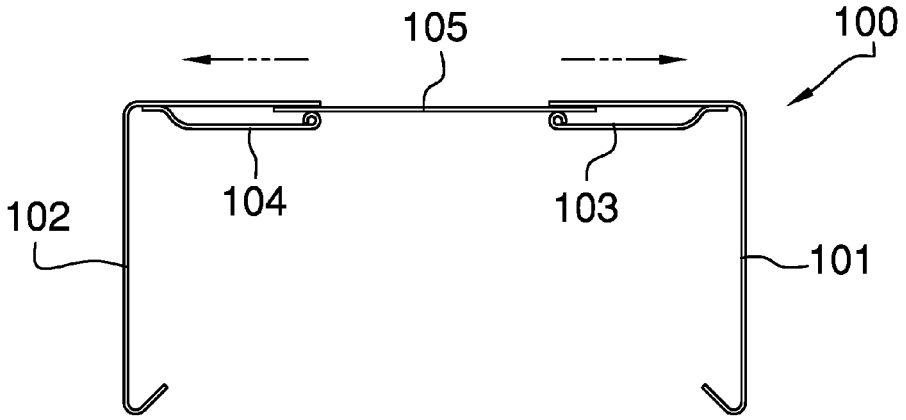
FIG. 3 is a detail view of an embodiment of the disclosure.
Figure 4:
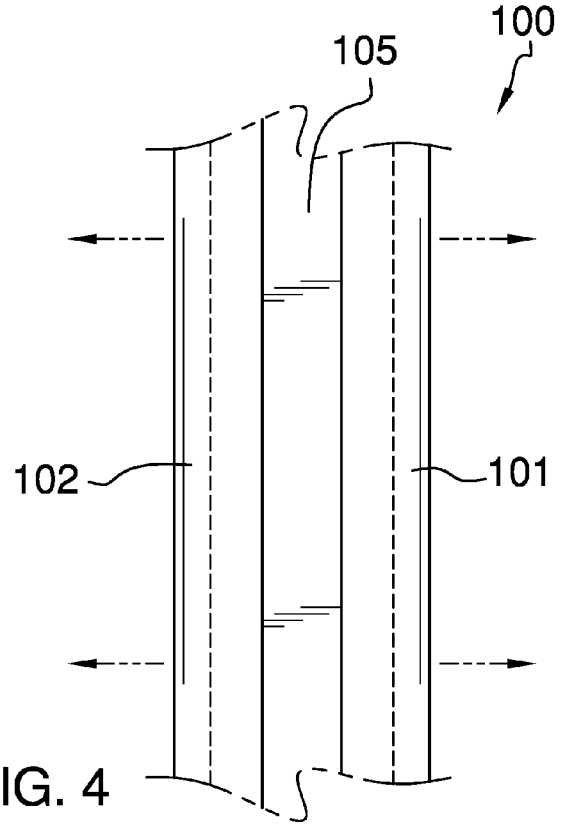
FIG. 4 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to two potential embodiments of the disclosure, which are illustrated in FIGS. 1 through 5. The adjustable coping cap 100 (hereinafter invention) comprises a first wing 101, a second wing 102, and an adjustable plate 105. The first wing 101 and the second wing 102 are attached through the use of the adjustable plate 105.

The first wing 101 is a piece of sheet metal that is further defined with a first end 111 and a second end 112. The first wing 101 is also formed with a first bend 121 and a second bend 122. The first bend 121 is a first angle 125 that is formed in the sheet metal between the first end 111 and the second bend 122. The second bend 122 is a second angle 126 that is formed between the first bend 121 and the second end 112. The first angle 125 is a right angle. The second angle 126 forms an acute angle. The portion of the first wing 101 between the second end 112 and the second bend 122 forms a spring that holds the second end 112 of the first wing 101 against the wall 131 the invention 100 is protecting. The first wing 101 has attached to it a first spring 103. The first spring 103 is a cantilever spring that is placed on the side of the first wing 101 that is proximal the wall 131 the invention 100 is protecting. The first spring 103 is further defined with a fifth end 115 and a sixth end 116. The fifth end 115 is attached to the first wing 101 such that it is distal from the first end 111. The sixth end 116 is not attached to the first wing 101 and is proximal to the first end 111. As space between the sixth end 116 and the first wing 101 is separated, the cantilever action of the first spring 103 pushes the sixth end 116 towards the first wing 101. When the adjustable plate 105 is placed between the sixth end 116 and the first wing 101 the cantilever action of the first spring 103 will hold the adjustable plate 105 in position.

The second wing 102 is a piece of sheet metal that is further defined with a third end 113 and a fourth end 114. The second wing 102 is also formed with a third bend 123 and a fourth bend 124. The third bend 123 is a third angle 127 that is formed in the sheet metal between the third end 113 and the fourth bend 124. The fourth bend 124 is a fourth angle 128 that is formed between the third bend 123 and the fourth end 114. The third angle 127 is a right angle. The fourth angle 128 forms an acute angle. The portion of the second wing 102 between the fourth end 114 and the fourth bend 124 forms a spring that holds the fourth end 114 of the second wing 102 against the wall 131 the invention 100 is protecting. The second wing 102 has attached to it a second spring 104. The second spring 104 is a cantilever spring that is placed on the side of the second wing 102 that is proximal the wall 131 the invention 100 is protecting.

The second spring 104 is further defined with a seventh end 117 and an eighth end 118. The seventh end 117 is attached to the second wing 102 such that it is distal from the third end 113. The eighth end 118 is not attached to the second wing 102 and is proximal to the third end 113. As space between the eighth end 118 and the second wing 102 is separated, the cantilever action of the second spring 104 pushes the eighth end 118 towards the second wing 102. When the adjustable plate 105 is placed between the eighth end 118 and the second wing 102 the cantilever action of the second spring 104 will hold the adjustable plate 105 in position.

The adjustable plate 105 is formed from sheet metal that is further defined with a ninth end 119 and a tenth end 120. The ninth end 119 of the adjustable plate 105 is placed between the first spring 103 and the first wing 101. The tenth end 120 is placed between the second spring 104 and the second wing 102.

To use the invention 100, the invention 100 is brought to the wall 131 where it is to be used. The first wing 101 and the second wing 102 are separated until the span between the first wing 101 and the second wing 102 is wider than the wall 131. The invention 100 positioned over the wall 131 and then the first wing 101 and the second wing 102 are pushed together until a satisfactory fit on the wall 131 is achieved. The invention 100 is then attached to the wall 131 in the same manner as regular coping.

In the first potential embodiment of the disclosure, as illustrated in FIGS. 1 through 4, the adjustable plate 105 is a flat piece of sheet metal.

Figure 5:
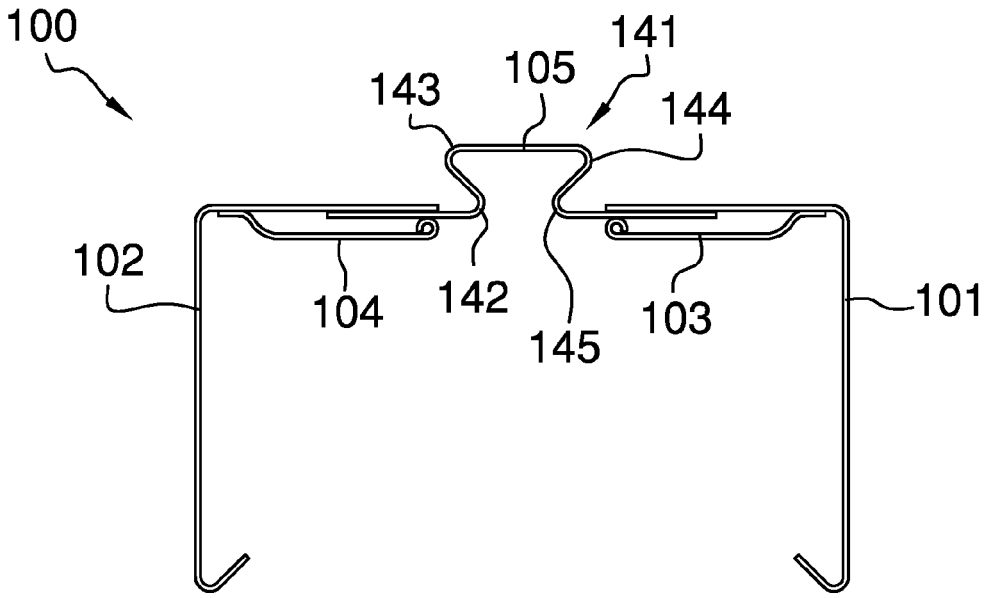
FIG. 5 is a front view of an alternative embodiment of the disclosure.

In the second potential embodiment of the disclosure, as illustrated in FIG. 5, the adjustable plate 105 further comprises an additional structure 141 that is formed in the center of the adjustable plate 105. The additional structure further comprises a fifth bend 142, a sixth bend 143, a seventh bend 144 and an eighth bend 148 that combine to give the additional structure 141 a form that is similar to the profile view of an inverted Erlenmeyer flask.

The following definition was used in this disclosure:

Coping Cap: As used in this disclosure, a coping cap is a protective cover or cap that is placed on top of and over the sides of an exterior wall.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A coping cap comprising:
a first wing, a second wing, and an adjustable plate;
wherein the coping cap is adjustable;
where the width of the coping cap is adjusted to fit the width of a wall;
wherein the first wing and the second wing are attached through the use of the adjustable plate;
wherein the first wing is formed from sheet metal;
wherein the first wing is further defined with a first end and a second end;
wherein the first wing is also formed with a first bend and a second bend;
wherein the first bend is further formed with a first angle;
wherein the second bend is formed with a second angle;
wherein the first angle is right;
wherein the second angle is acute;
wherein the first bend is formed between the first end and the second bend;
wherein the second bend is formed between the first bend and the second end;
wherein the first wing has attached to it a first spring;
wherein the first spring is further defined with a fifth end and a sixth end;
wherein the first spring is a cantilever spring;
wherein the fifth end is attached to the first wing such that the fifth end is distal from the first end;
wherein when the adjustable plate is placed between the sixth end and the first wing the cantilever action of the first spring will hold the adjustable plate in position.

2. The coping cap according to claim 1 wherein
the second wing is formed from sheet metal;
wherein the second wing is further defined with a third end and a fourth end.

3. The coping cap according to claim 2 wherein the second wing is also formed with a third bend and a fourth bend.

4. The coping cap according to claim 3 wherein the third bend is further formed with a third angle;
wherein the fourth bend is formed with a fourth angle;
wherein the third angle is right;
wherein the fourth angle is acute.

5. The coping cap according to claim 4 wherein the third bend is formed between the third end and the fourth bend.

6. The coping cap according to claim 5 wherein the fourth bend is formed between the third bend and the fourth end.

7. The coping cap according to claim 6 wherein the second wing has attached to it a second spring;
wherein the second spring is further defined with a seventh end and an eighth end;
wherein the second spring is a cantilever spring.

8. The coping cap according to claim 7 wherein the seventh end is attached to the second wing such that the seventh end is distal from the third end.

9. The coping cap according to claim 8 wherein when the adjustable plate is placed between the eighth end and the second wing the cantilever action of the second spring will hold the adjustable plate in position.

10. The coping cap according to claim 9 wherein the adjustable plate is a flat piece of sheet metal.

11. The coping cap according to claim 8 wherein the adjustable plate further comprises an additional structure that is formed in the center of the adjustable plate.

12. The coping cap according to claim 11 wherein the additional structure further comprises a fifth bend, a sixth bend, a seventh bend and an eighth bend.

* * * * *